US011394158B1

(12) United States Patent
Rangi et al.

(10) Patent No.: US 11,394,158 B1
(45) Date of Patent: Jul. 19, 2022

(54) ELECTRICAL CONNECTOR WITH ADJUSTABLE TERMINALS

(71) Applicant: Lear Corporation, Southfield, MI (US)

(72) Inventors: Bhupinder Rangi, Novi, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 17/136,762

(22) Filed: Dec. 29, 2020

(51) Int. Cl.

| | |
|---|---|
| ***H01R 13/684*** | (2011.01) |
| ***H01R 13/629*** | (2006.01) |
| ***H01H 85/02*** | (2006.01) |
| ***H01R 33/95*** | (2006.01) |

(52) U.S. Cl.
CPC ..... *H01R 13/684* (2013.01); *H01H 85/0241* (2013.01); *H01R 13/629* (2013.01); *H01R 33/95* (2013.01); *H01H 2085/025* (2013.01); *H01R 2201/26* (2013.01)

(58) Field of Classification Search
CPC .. H01R 13/6315; H01R 31/08; H01R 31/085; H01R 13/684; H01R 13/629; H01R 33/95; H01R 2201/26; H01H 85/0241; H01H 2085/025
USPC ..... 439/246–252, 509, 510, 512
See application file for complete search history.

(56) References Cited

U.S. PATENT DOCUMENTS

| | | | | |
|---|---|---|---|---|
| 5,201,667 | A * | 4/1993 | Endo | H01R 13/5205 439/189 |
| 9,397,459 | B2 | 7/2016 | Butcher et al. | |
| 9,824,837 | B2 | 11/2017 | Ooishi et al. | |
| 9,979,141 | B2 | 5/2018 | Yasuda et al. | |
| 2013/0089996 | A1* | 4/2013 | Zhao | H01R 11/288 439/212 |
| 2019/0260169 | A1* | 8/2019 | Schmitz | H01R 9/2675 |

FOREIGN PATENT DOCUMENTS

| | | | |
|---|---|---|---|
| WO | 2019206933 | A1 | 10/2019 |

* cited by examiner

*Primary Examiner* — Gary F Paumen
(74) *Attorney, Agent, or Firm* — MacMillan, Sobanski & Todd, LLC

(57) ABSTRACT

An electrical connector includes a terminal housing. A first terminal is retained in the terminal housing for movement relative to the terminal housing. A second terminal is also retained in the terminal housing for movement relative to the terminal housing. A flexible bus bar is connected to the first terminal and to the second terminal. The first terminal is able to be moved independently of the second terminal.

15 Claims, 13 Drawing Sheets

ELECTRICAL CONNECTOR WITH ADJUSTABLE TERMINALS

BACKGROUND OF THE INVENTION

This invention relates in general to an electrical circuit interrupt. More specifically, this invention relates to a manual service disconnect for an electric battery.

A manual service disconnect is provided as a safety device on battery electric vehicles. The manual service disconnect is provided at the batteries and is a removable breaker for a high voltage circuit. When maintenance work on high voltage parts of the vehicle are being done, the manual service disconnect can be removed in order to interrupt current flow. An example of a manual service disconnect is described in U.S. Pat. No. 9,397,459.

The physical shape and size of the manual service disconnect can vary based on the available space in the vehicle and the desired position of the manual service disconnect. In order to ensure that the high voltage circuit is maintained when the manual service disconnect it closed, it is desirable to keep all components of the manual service disconnect in their desired positions during assembly and to account for any variations in component size that can occur during manufacturing. It is desirable to have an improved manual service disconnect.

SUMMARY OF THE INVENTION

The invention relates to an electrical connector. The electrical connector includes a terminal housing. A first terminal is retained in the terminal housing for movement relative to the terminal housing. A second terminal is also retained in the terminal housing for movement relative to the terminal housing. A flexible bus bar is connected to the first terminal and to the second terminal. The first terminal is able to be moved independently of the second terminal.

In another embodiment of the invention, the electrical connector includes a third terminal retained in the terminal housing for movement relative to the terminal housing. The electrical connector further includes a fourth terminal retained in the terminal housing for movement relative to the terminal housing. A second flexible bus bar is connected to the third terminal and to the fourth terminal. The third terminal is able to be moved independently of the fourth terminal.

A further embodiment of the invention relates to an electrical connector with a terminal housing. A first terminal includes a first terminal guide attached to an outer surface thereof. The first terminal is retained in the terminal housing for movement relative to the terminal housing perpendicular to a terminal axis. A second terminal includes a second terminal guide attached to an outer surface thereof. The second terminal is retained in the terminal housing for movement relative to the terminal housing perpendicular to the terminal axis. A third terminal includes a third terminal guide attached to an outer surface thereof. The third terminal is retained in the terminal housing for movement relative to the terminal housing perpendicular to the terminal axis. A fourth terminal includes a fourth terminal guide attached to an outer surface thereof. The fourth terminal is retained in the terminal housing for movement relative to the terminal housing perpendicular to the terminal axis. A first flexible bus bar is connected to the first terminal and to the second terminal. The first terminal is able to be moved independently of the second terminal. A second flexible bus bar is connected to the third terminal and the fourth terminal. The third terminal is able to be moved independently of the fourth terminal. A terminal retainer is attached to the terminal housing. The first terminal guide, the second terminal guide, the third terminal guide, and the fourth terminal guide extend through respective guide openings in the terminal retainer. Each of the terminal guides, are smaller than the respective guide opening, and each includes a respective retaining flange that is larger than the guide opening.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
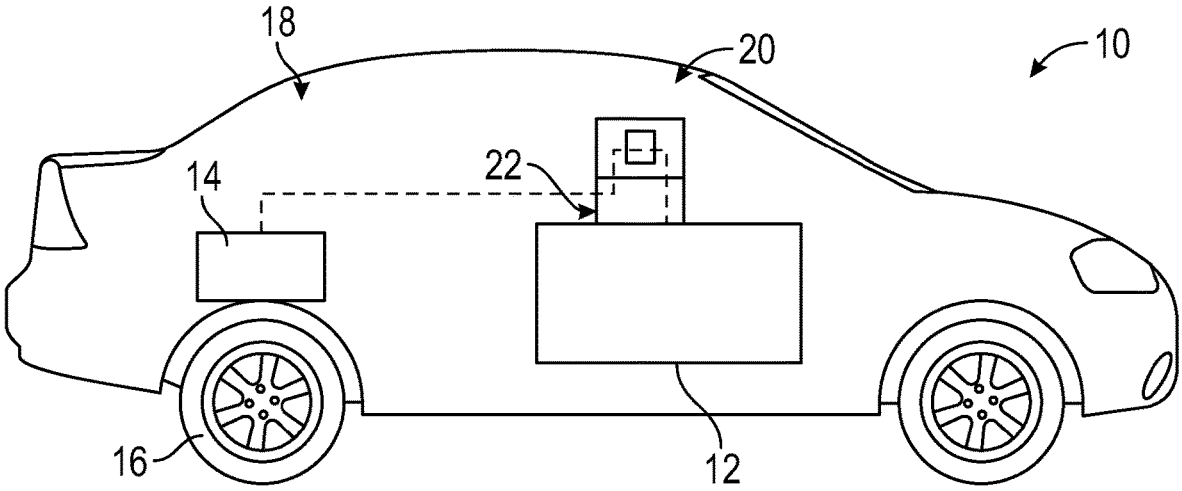
FIG. 1 is a schematic view of an electric vehicle including a high voltage battery with a manual service disconnect in accordance with the invention.

Referring now to the drawings, there is illustrated in FIG. 1 a schematic view of an electric vehicle, indicated generally at 10. The illustrated vehicle 10 may be a hybrid vehicle, or any desired type of vehicle that includes a battery 12. The battery 12 may be a single battery, or may be multiple battery cells. The electric vehicle 10 includes an electric motor 14 that is connected to drive wheels 16. A primary circuit, indicated at 18, provides current flow from the battery 12 through the electric motor 14. The illustrated electric motor 14 is one type of electric equipment that may be connected to the battery 12, and it should be appreciated that any desired electric equipment may be powered by the primary circuit 18.

The electric vehicle 10 includes a manual service disconnect, indicated generally at 20. The manual service disconnect 20 allows a technician to open the primary circuit 18 at the battery 12, for example, when the electric motor 14 is to be serviced. It should be appreciated that the primary circuit 18 is only described in a simplified form sufficient for the understanding of the manual service disconnect 20. The preferred embodiment of the invention will be described in connection with the battery 12 on the electric vehicle 10, but it should be appreciated that the invention may be used as an electric disconnect in any desired circuit.

Figure 2:
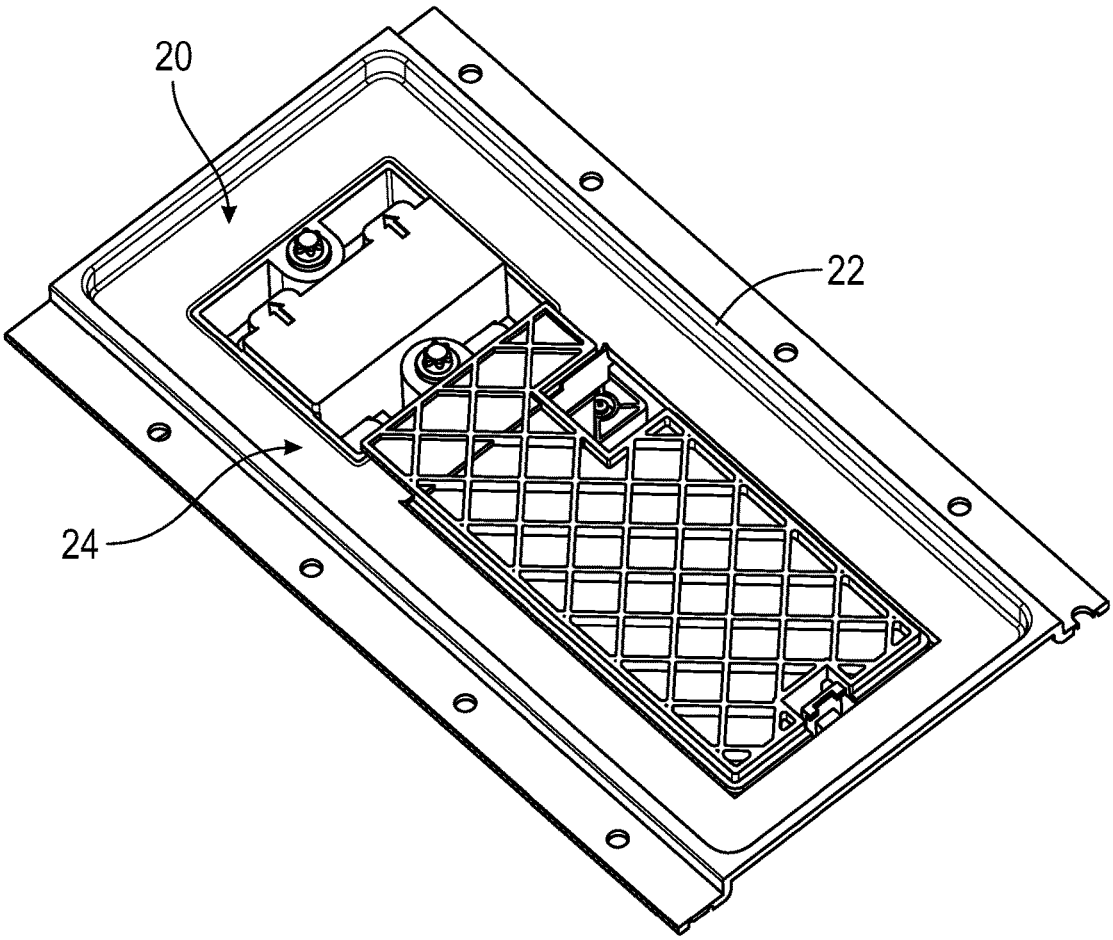
FIG. 2 is a perspective view of a portion of the battery pack with the manual service disconnect shown in a mated position.
Figure 3:
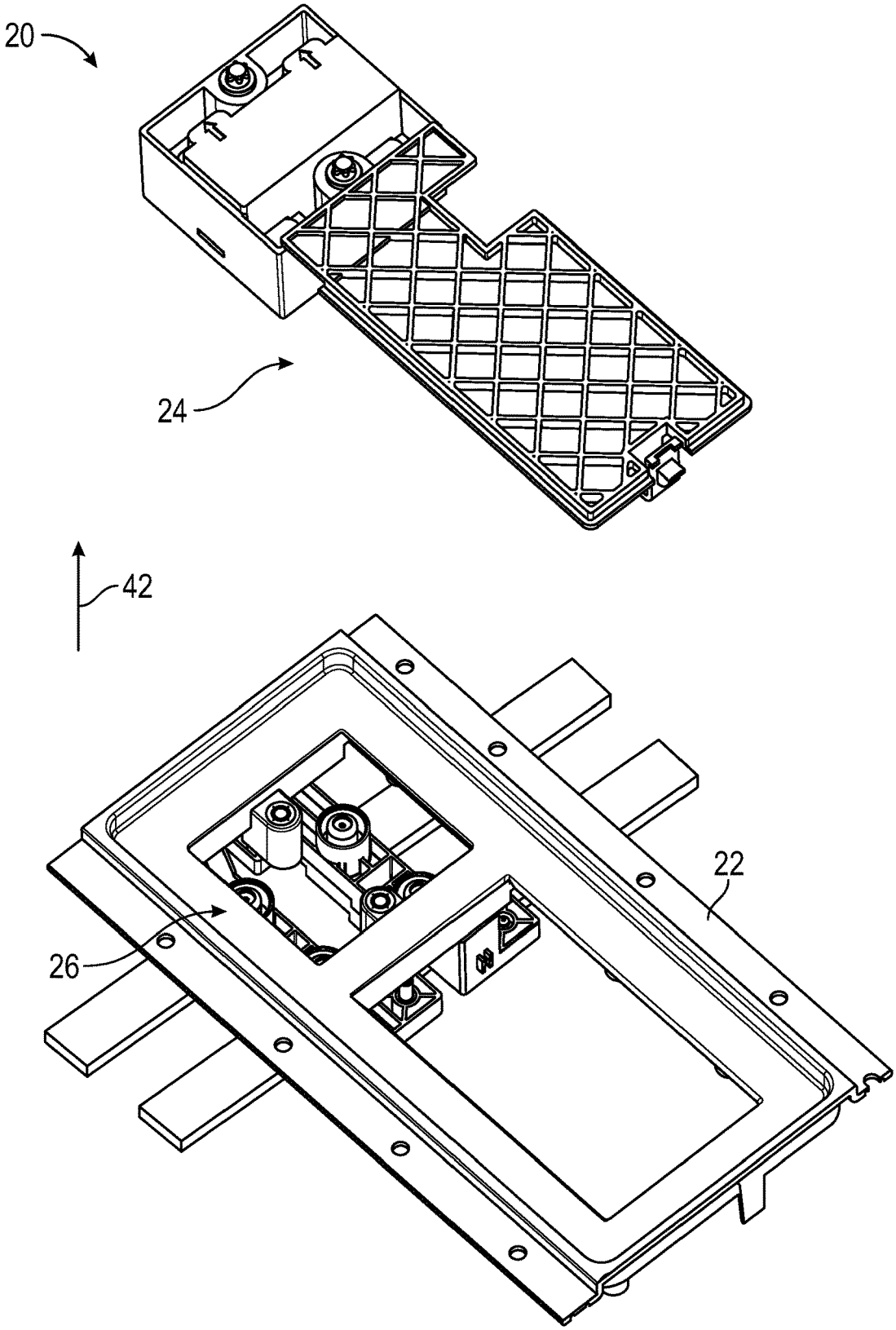
FIG. 3 is a partially exploded view of FIG. 2, with the manual service disconnect shown in an unmated position with a plug assembly removed from a header assembly, and with underlying parts of the battery pack visible.

Referring now to FIG. 2, there is illustrated a portion of an enclosure 22 for the battery 12 that includes the manual service disconnect 20. The manual service disconnect 20 includes a plug assembly 24 that is shown in a mated position in FIG. 2. Referring to FIG. 3, there is a view similar to FIG. 2, with the plug assembly 24 shown removed from the mated position, where the plug assembly 24 is separated from a header assembly, indicated at 26. When the plug assembly 24 is in the mated position shown in FIG. 2, the primary circuit 18 is closed. When the plug assembly 24 is not in the mate position, the primary circuit 18 is open.

Figure 4:
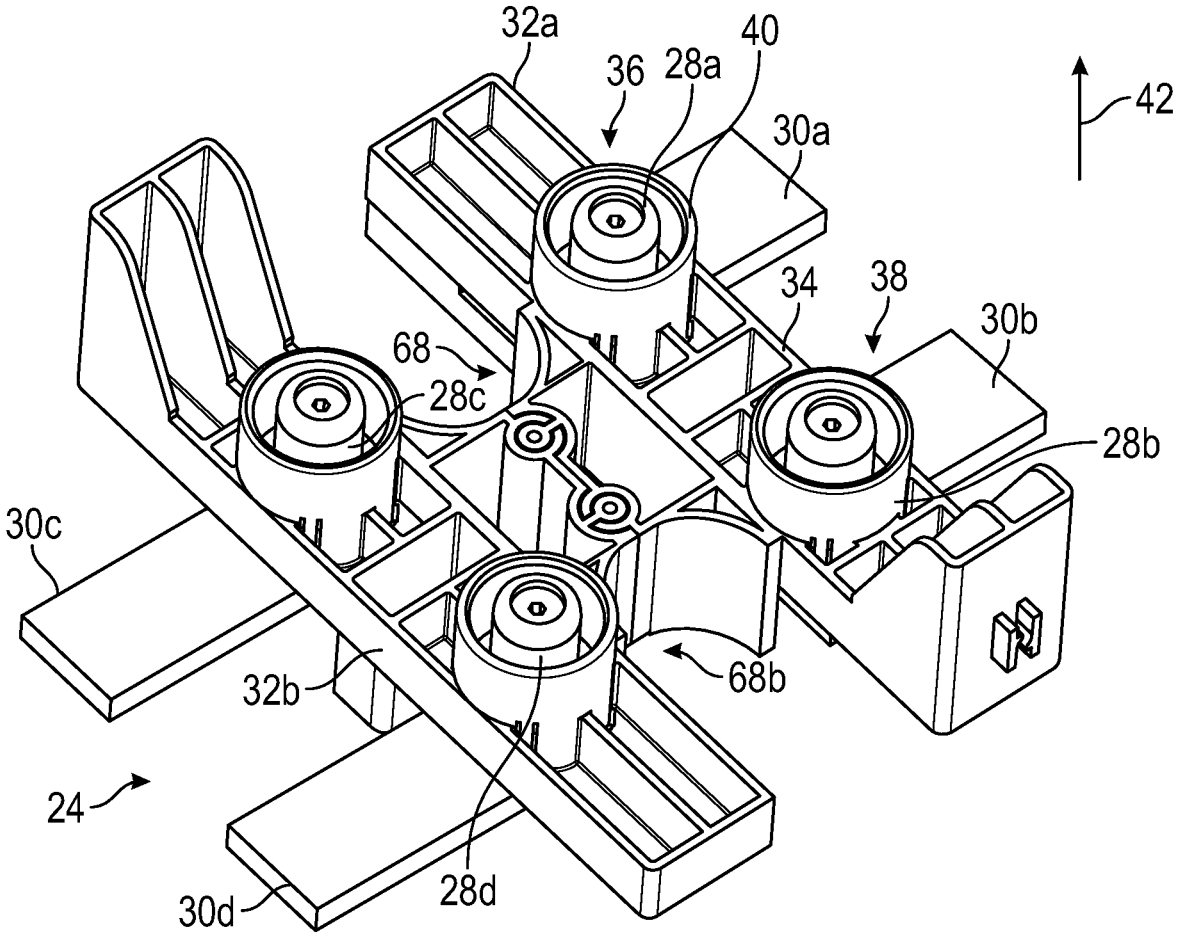
FIG. 4 is an enlarged, detailed view of a portion of the header assembly of the manual service disconnect.

Referring to FIG. 4, an enlarged view of the header assembly 26 is illustrated. The header assembly 26 includes four header terminals 28*a*, 28*b*, 28*c*, and 28*d*. Each of the header terminals 28*a*, 28*b*, 28*c*, and 28*d* is connected to a respective header bus bar 30*a*, 30*b*, 30*c*, and 30*d*. The header terminals 28*a*, 28*b*, 28*c*, and 28*d* are connected to the battery 12 and the primary circuit 18.

Figure 5:
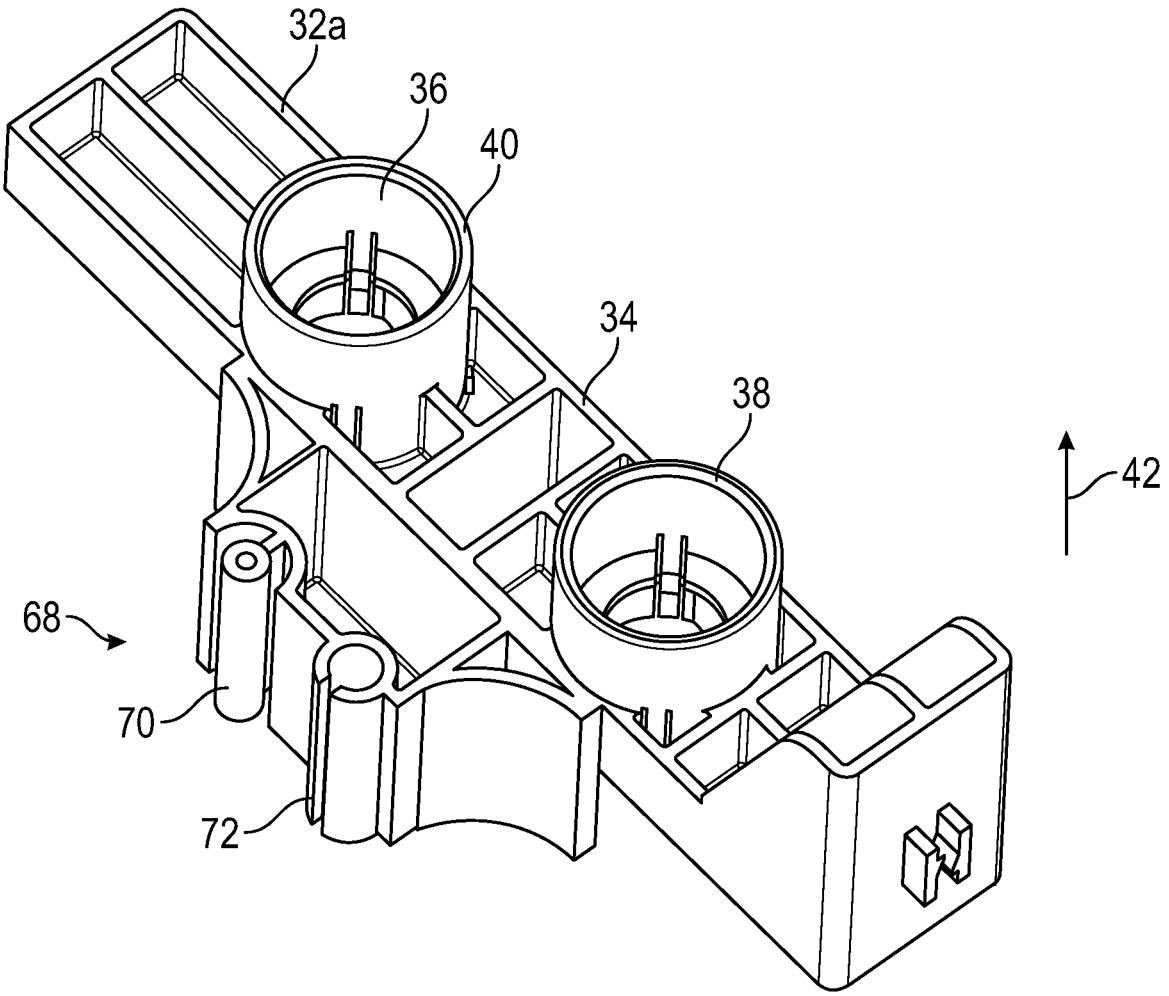
FIG. 5 is a perspective view of a terminal holder from the header assembly from FIG. 4.

The header assembly 26 includes two terminal holders 32*a* and 32*b*. The two illustrated terminal holders 32*a* and 32*b* are the same, and terminal holder 32*a* is illustrated in FIG. 5. The terminal holder 32*a* is molded from non-conductive plastic, but may be made of any desired material and may be made by any desired process. The terminal holder 32*a* includes a holder body 34. Two terminal mounts, indicated at 36 and 38, are located on the holder body 34. The terminal mounts 36 and 38 include similar features and only one will be described in detail. The terminal mount 36 includes a terminal shroud 40 that extends from the holder body 34 in a mate direction 42. The terminal shroud 40 is located around a terminal axis 44 that extends parallel to the mate direction 42. The terminal axis 44 extends through a terminal opening 46 that extends through the holder body 34.

Figure 6:
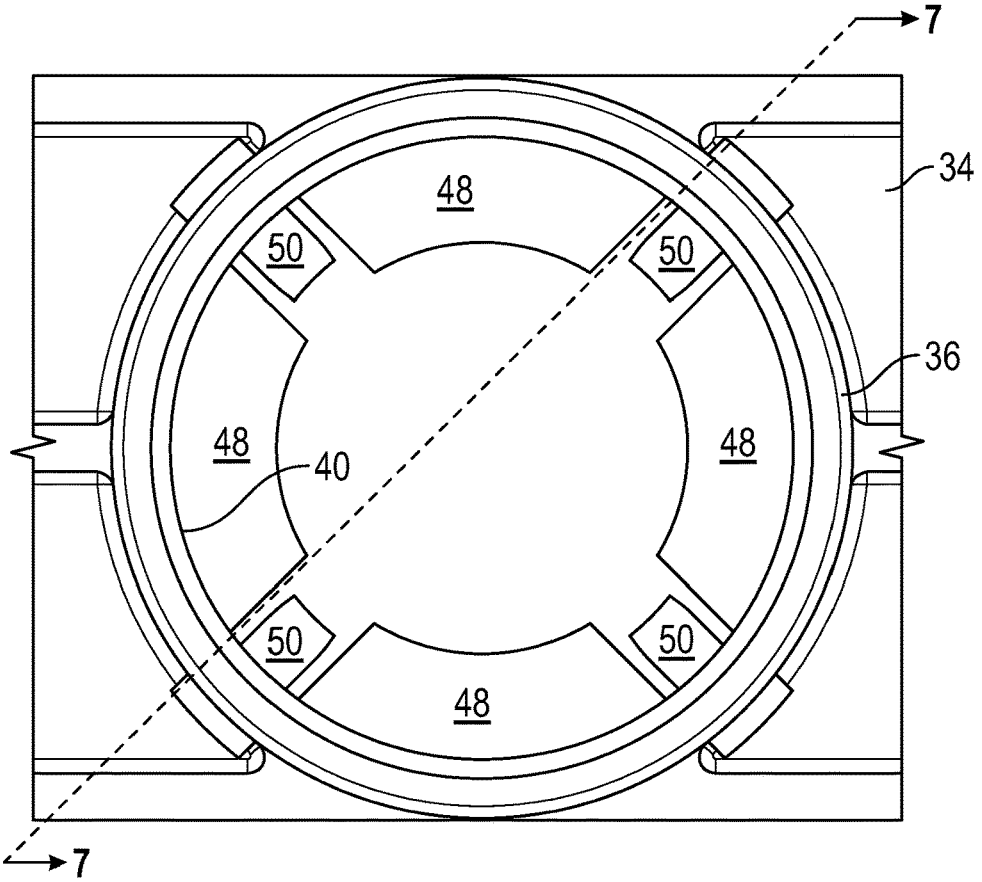
FIG. 6 is an enlarged, plan view of a portion of the terminal holder.
Figure 7:
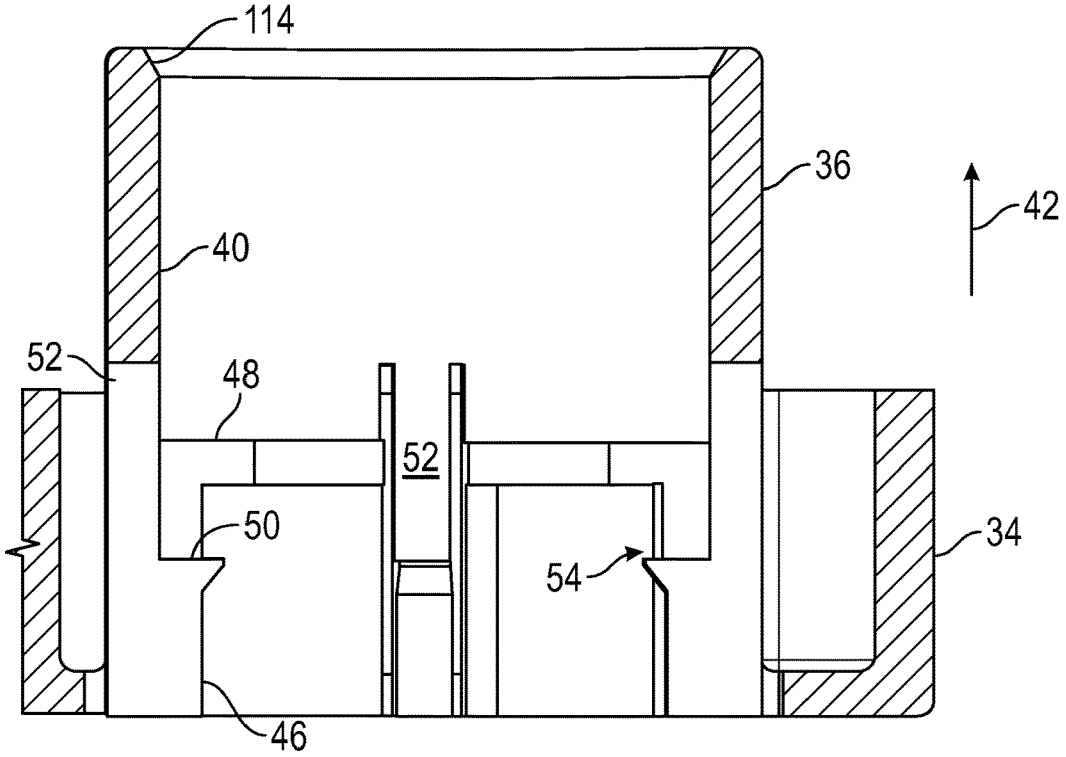
FIG. 7 is a cross-sectional view taken along the line 7-7 of FIG. 6.

FIG. 6 is an enlarged, top view of the terminal mount 36, and FIG. 7 is a cross-sectional view taken along the line 7-7 of FIG. 6. The illustrated terminal shroud 40 has a circular cross-sectional shape around the terminal axis 44, but may have any desired shape. The terminal mount 36 includes a lock flange 48 that extends from the terminal shroud 40 toward the terminal axis 44. In the illustrated embodiment, as best shown in FIG. 6, the lock flange 48 includes four separate parts that are spaced-apart around an interior circumference of the terminal shroud 40. However, the lock flange 48 may have any desired shape and distribution within the terminal shroud 40.

The terminal mount 36 also includes lock fingers 50 that extend from the terminal shroud 40 toward the terminal axis 44. In the illustrated embodiment, the terminal mount 36 includes four lock fingers 50 that spaced-apart around the interior circumference of the terminal shroud 40. However, the terminal mount 36 may have any desired number and distribution of lock fingers 50. Each of the lock fingers 50 extends from a respective resilient lock arm 52 that extends from the terminal shroud 40. A terminal lock space, indicated at 54, is defined between the lock flange 48 and the lock fingers 50.

Figure 8:
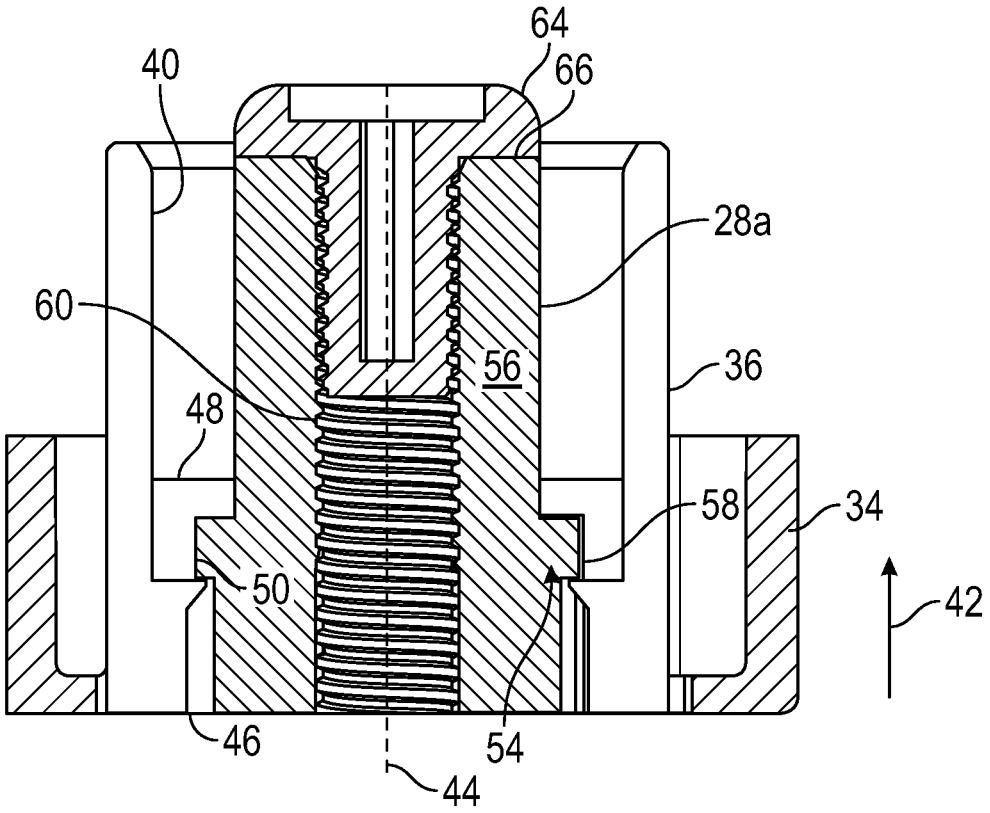
FIG. 8 is a view similar to FIG. 7, with a terminal installed in the terminal holder and prior to attachment to a bus bar.
Figure 8:
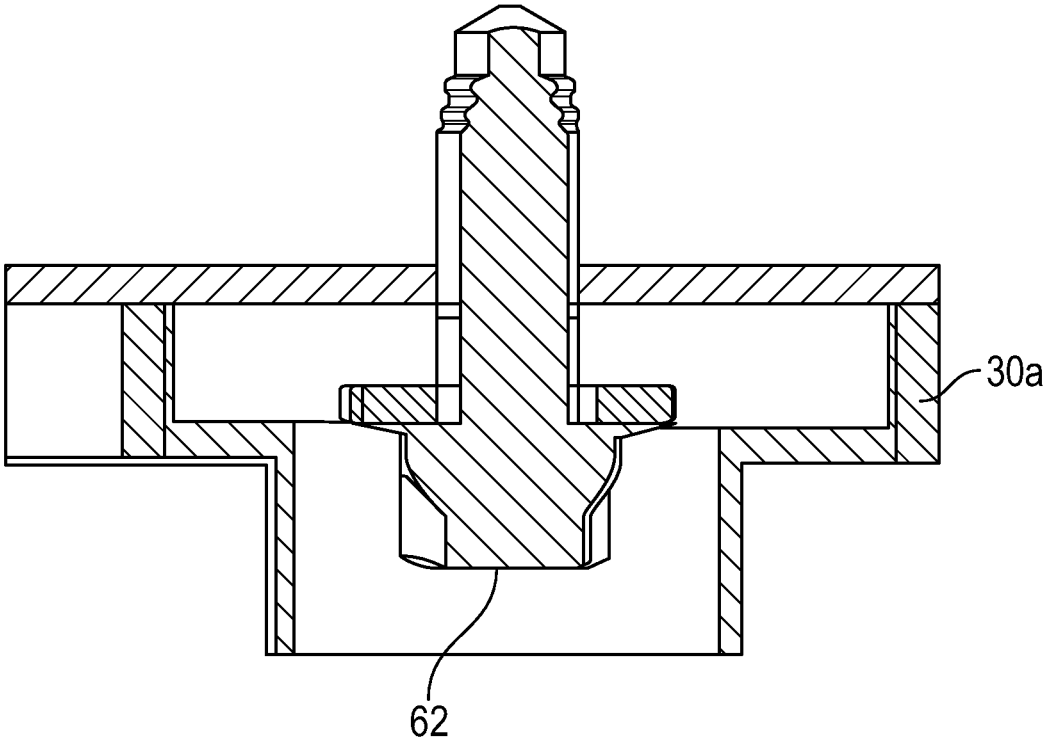

Referring now to FIG. 8, a view similar to FIG. 7 is illustrated, with the header terminal 28*a* shown inserted into the terminal mount 36. Additionally, the header bus bar 30*a* is shown in FIG. 8, prior to being connected to the header terminal 28*a*. The header terminal 28*a* includes a terminal body 56. In the illustrated embodiment, the terminal body 56 has a cylindrical cross-sectional shape around the terminal axis 44, but may have any desired shape. The header terminal 28*a* includes a terminal flange 58 that extends from the terminal body 56 away from the terminal axis 44. In order to install the header terminal 28*a* into the terminal mount 36, the header terminal 28*a* is inserted through the terminal opening 46 and moved in the mate direction 42.

The terminal flange 58 engages the lock fingers 50 and pushes the lock fingers 50 away from the terminal axis 44. When the header terminal 28*a* has been inserted into the terminal mount 36 so that the terminal flange 58 is located in the terminal lock space 54, the terminal lock fingers 50 rebounds toward the terminal axis 44. The terminal flange is then retained in the terminal lock space 54 between the lock flange 48 and the lock fingers 50 and the header terminal 28*a* is retained in the terminal mount 36.

The header terminal 28*a* includes a mount hole 60. The mount hole 60 passes through the terminal body 56 and the terminal axis 44 passes through the mount hole 60. The mount hole 60 includes threads to retain a threaded connector 62. As illustrated in FIG. 8, the threaded connector 62 is located through a portion of the header bus bar 30*a* and is not inserted into the mount hole 60.

A touch protection 64 is located on a mate end 66 of the header terminal 28*a*. The touch protection 64 extends into the mount hole 60 and engages the threads to retain the touch protection 64 in the illustrated position. The touch protection 64 is made of a non-conductive material and helps prevent unintended electrical contact with the terminal body 56. As illustrated, the terminal body 56 is located within the terminal shroud 40 and the terminal shroud 40 and the touch protection 64 limit the space available to engage in electrical contact with the terminal body 56.

Figure 9:
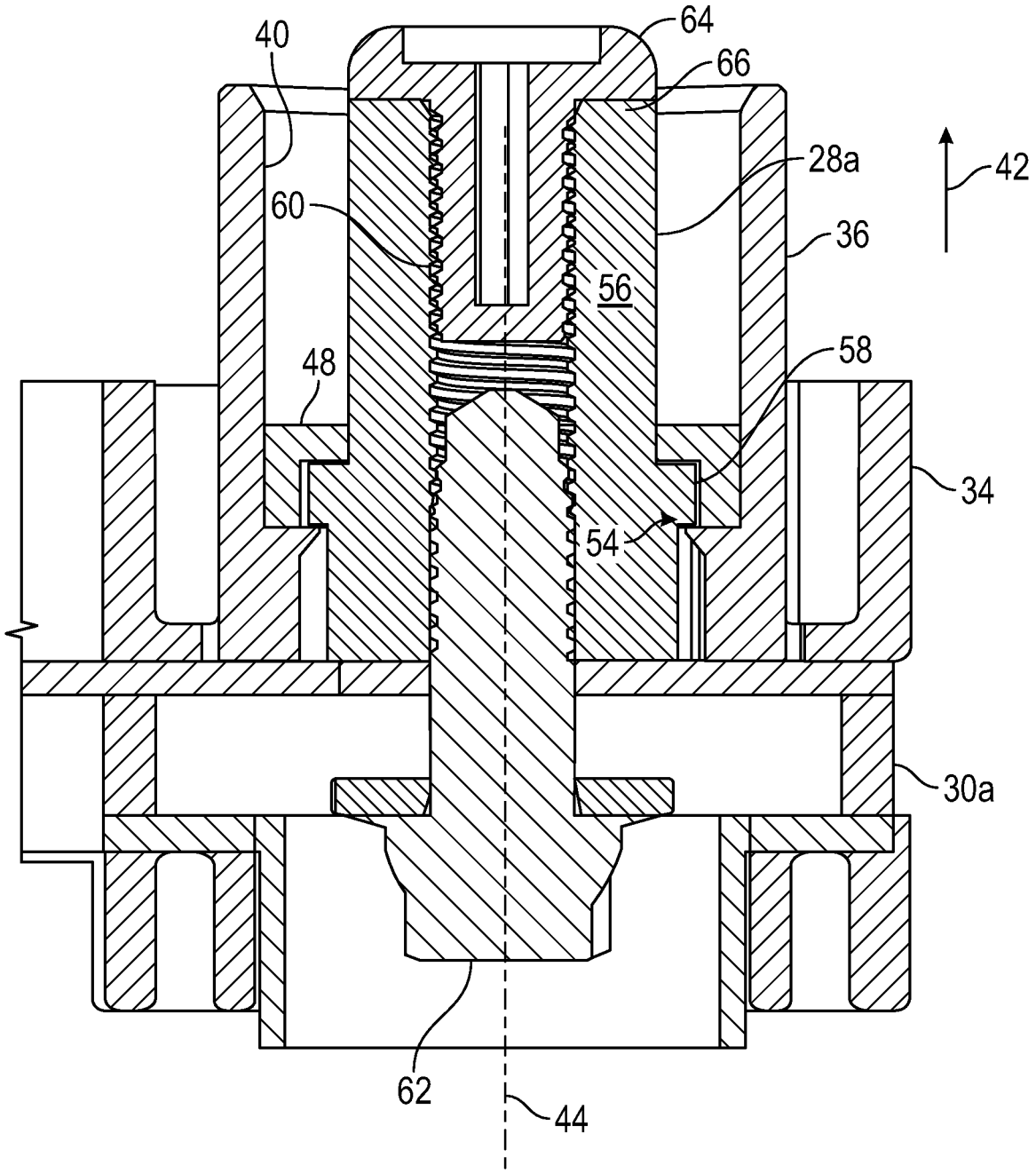
FIG. 9 is a view similar to FIG. 8, with the terminal shown attached to the bus bar.

FIG. 9 is a view similar to FIG. 8, with the threaded connector 62 inserted into the mount hole 60. The threaded connector 62 engages the threads in the mount hole 60 to retain the terminal body 56 in contact with the header bus bar 30*a*. The illustrated embodiment uses the threaded mounting hole 60 to retain the terminal body 56 in the illustrated position relative to header bus bar 30*a* and the touch protection 64; however, any desired attachment mechanism may be used.

Figure 10:
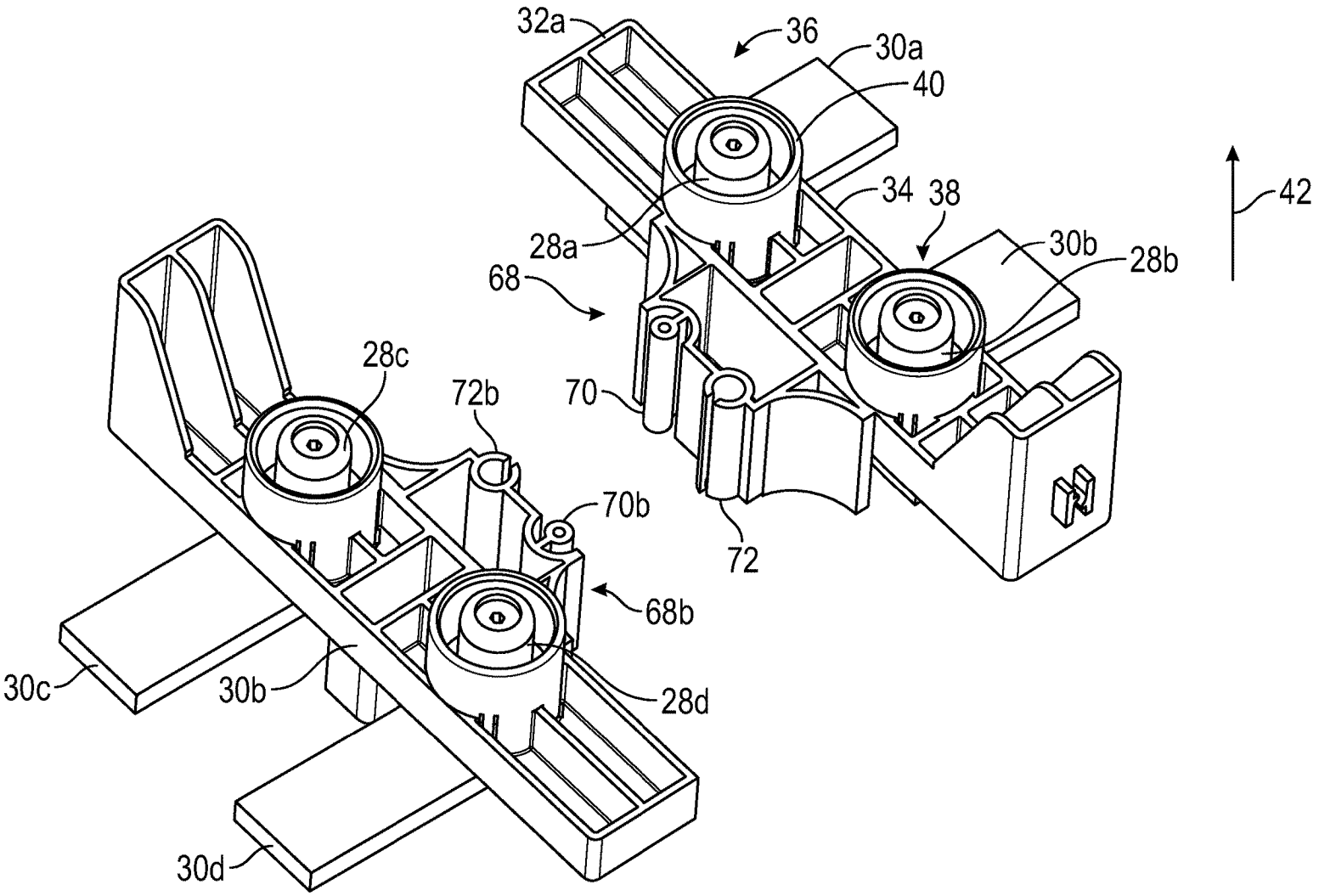
FIG. 10 is a partially-exploded, perspective view of the header assembly, with four bus bars shown attached to respective terminals.

Referring now to FIG. 10, there is illustrated a view of the partially assembled header assembly 26. As illustrated in FIG. 10, the header terminal 28*a* is retained in the terminal mount 36 on the terminal holder 32*a* and is connected to the header bus bar 30*a*, as previously described. Additionally, the header terminal 28*b* is retained in the terminal mount 38 on the terminal holder 32*a* and is connected to the header bus bar 30*b*. Similarly, the header terminals 28*c* and 28*d* are retained on the terminal holder 32*b* and are connected to the respective header bus bars 30*c* and 30*d*.

The terminal holder 32*a* includes an alignment lock, indicated generally at 68. As previously described, the terminal holder 32*b* is the same as the terminal holder 32*a* and thus includes a similar alignment lock 68*b*. The alignment locks 68 and 68*b* allow the terminal holders 32*a* and

32*b* to be assembled into a desired position relative to each other. In the illustrated embodiment, the alignment lock 68 includes a post 70 and a collar 72 that are attached to the holder body 34. Both the post 70 and the collar 72 extend parallel to the terminal axis 44. The terminal holders 32*a* and 32*b* are connected to each other by inserting the post 70 into a collar 72*b* on the terminal holder 32*b*, and inserting a post 70*b* on the terminal holder 32*b* into the collar 72. This allows the terminal holder 32*a* to be connected to the bus bars 30*a* and 30*b* as part of a first sub-assembly (not shown) while the terminal holder 32*b* is connected to the bus bars 30*c* and 30*d* as part of a second sub-assembly (not shown). The two sub-assemblies can then be assembled together into the header assembly 26 shown in FIG. 4, and the terminal holders 32*a* and 32*b* allow the header terminals 28*a*, 28*b*, 28*c*, and 28*d* to be placed in the desired relative positions.

Figure 11:
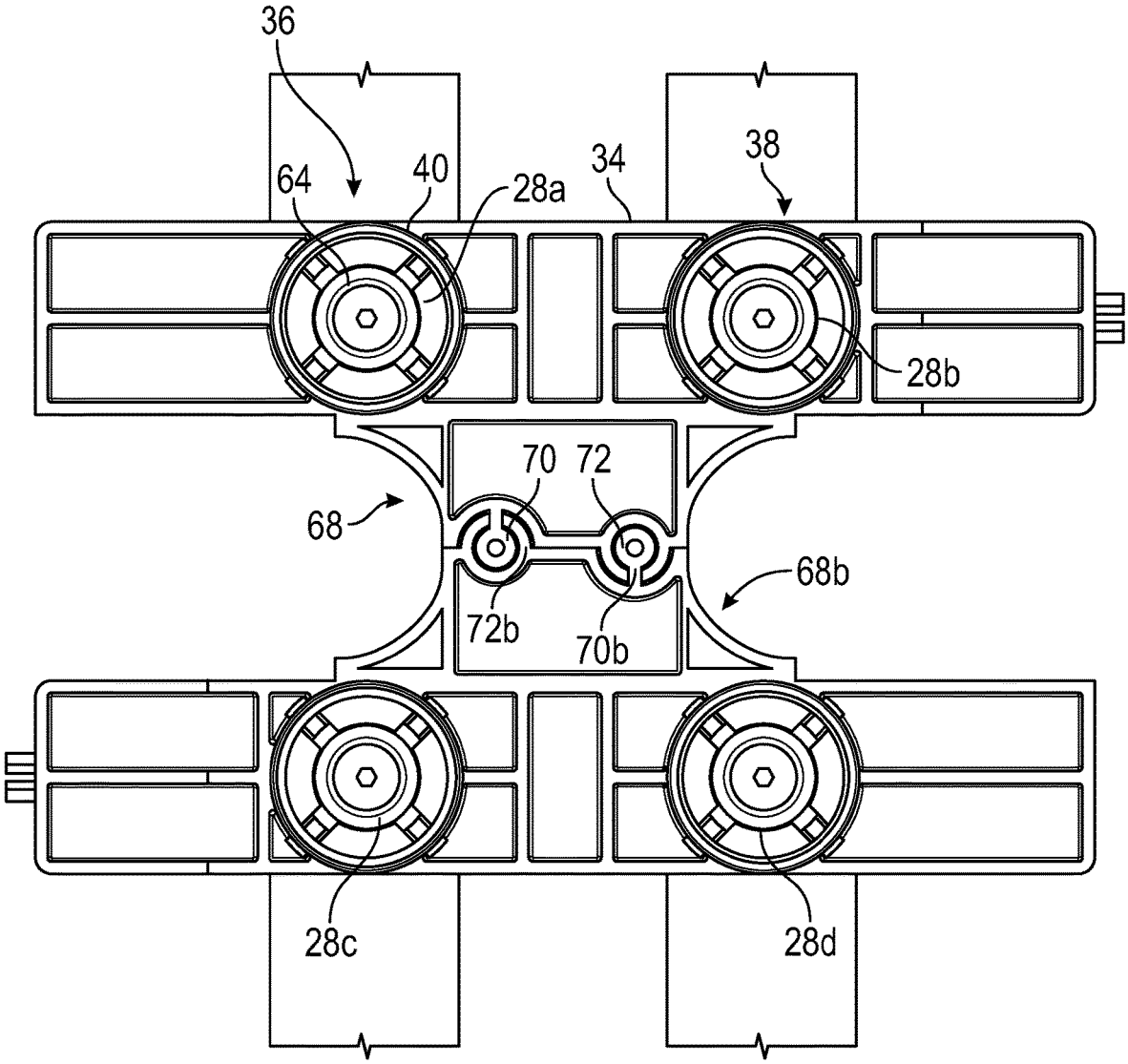
FIG. 11 is a plan view of the header from FIG. 4.

Referring to FIG. 11, a top view of the header assembly 26 is illustrated. As shown, the header terminals 28*a*, 28*b*, 28*c*, and 28*d* are arranged generally at the corners of a rectangular-shaped space. However, the header terminals 28*a*, 28*b*, 28*c*, and 28*d* may have any desired relative positions.

Figure 12:
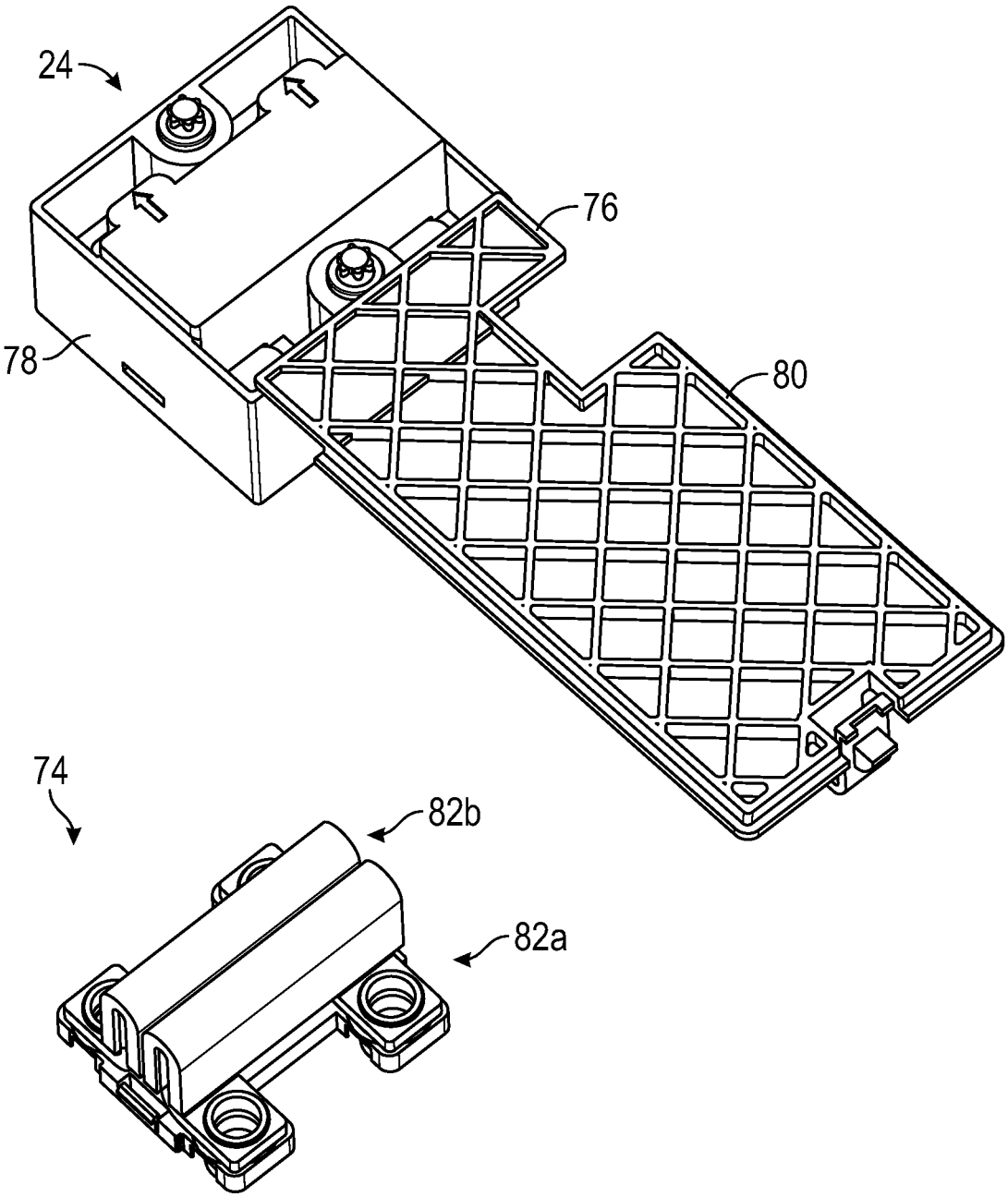
FIG. 12 is a partially exploded, perspective view of the plug assembly from FIG. 3, with a terminal assembly shown separate from a plug body.

Referring now to FIG. 12, there is illustrated a partially exploded view of the plug assembly 24 from FIG. 3. The plug assembly 24 is illustrated with a terminal assembly, indicated generally at 74, shown separate from a plug body 76. The illustrated plug body 76 is molded from non-conductive plastic, but may be made of any desired material and may be made by any desired process. The plug assembly 24 includes a terminal housing 78 that is part of the plug body 76. When the plug assembly 24 is assembled, the terminal assembly 74 is retained in the terminal housing 78, as described below. The plug assembly 24 also includes a plug handle 80 that is part of the plug body 76. The plug handle 80 assists the technician in manipulating and placing the plug assembly 24.

Figure 13:
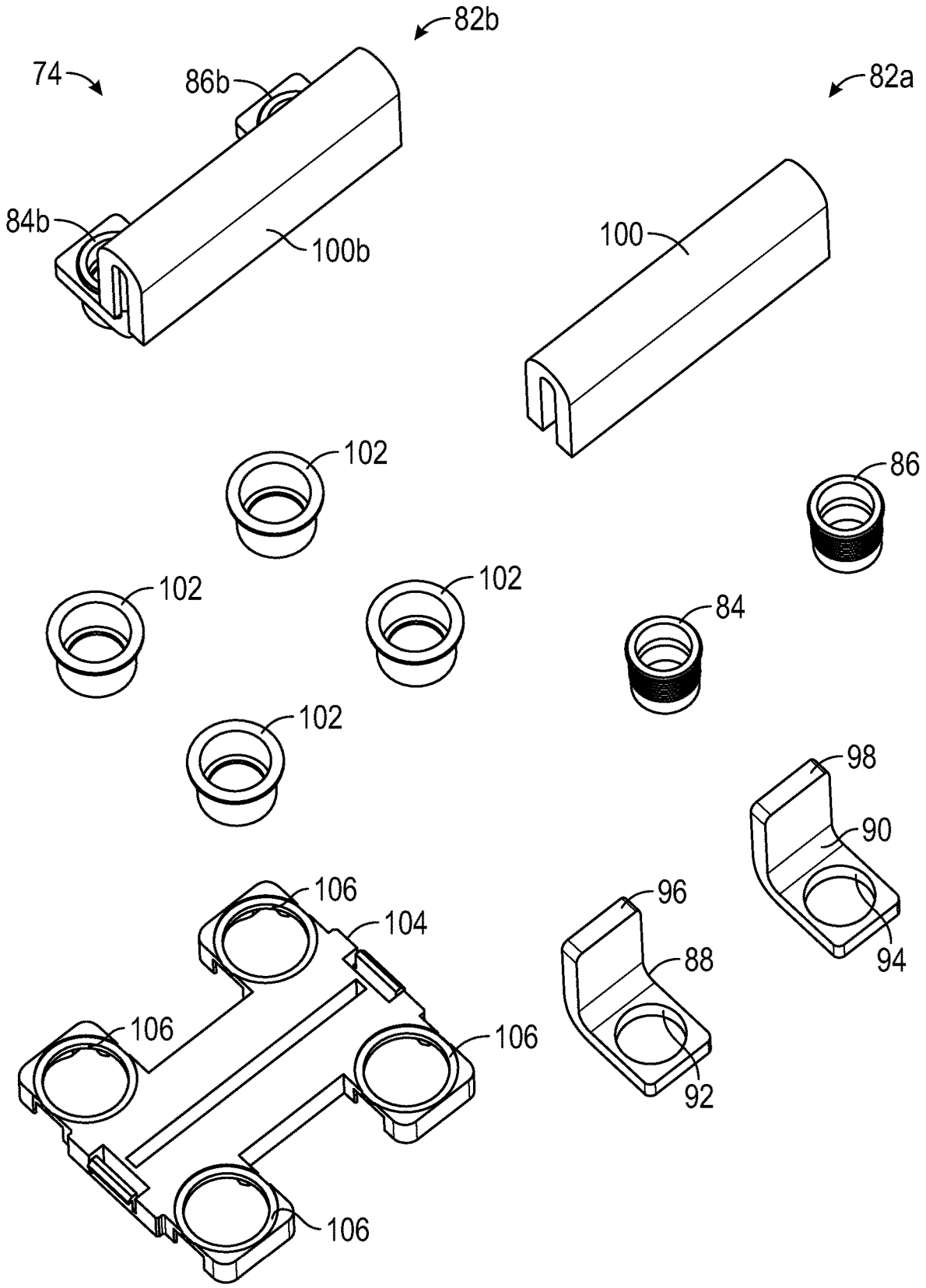
FIG. 13 is an enlarged, exploded view of the terminal assembly from FIG. 12.

Referring to FIG. 13, there is illustrated an enlarged, partially exploded view of the terminal assembly 74. The terminal assembly 74 includes two bus bar assemblies, indicated at 82*a* and 82*b* respectively. The bus bar assemblies 82*a* and 82*b* include similar components and only one will be described in detail. In FIG. 13, the bus bar assembly 82*a* is shown exploded while the bus bar assembly 82*b* is shown assembled.

The bus bar assembly 82*a* includes two plug terminals 84 and 86. The illustrated plug terminals 84 and 86 each have a cylindrical shape and are adapted to mate with the previously described header terminal 28*a*. However, the plug terminals 84 and 86 may have any desired shape. The bus bar assembly 82*a* includes two terminal leads 88 and 90. The terminal leads 88 and 90 are made of an L-shaped piece of sheet metal, but may be made of any desired material in any desired shape. The terminal leads 88 and 90 include respective terminal mounts 92 and 94. The terminal mount 92 allows the plug terminal 84 to be attached to the terminal lead 88. The illustrated terminal mount 92 is a hole through the terminal lead 88 that the plug terminal 84 is inserted into, but any desired attachment method may be used. Similarly, the terminal mount 94 allows the plug terminal 86 to be attached to the terminal lead 88. The terminal leads 88 and 90 also include respective tail ends 96 and 98.

The bus bar assembly 82*a* includes a flexible bus bar 100. The illustrated flexible bus bar 100 is made of an electrically conductive, braided metal. However, the flexible bus bar 100 may be made of any desired material. The flexible bus bar 100 is folded into a U-shape so that is engages two sides of the tail ends 96 and 98. The illustrated flexible bus bar 100 is attached to both of the terminal leads 88 and 90 by welding, but may be attached using any desired method. The flexible bus bar 100 provides an electrical connection between the plug terminals 84 and 86, while allowing relative movement between the plug terminals 84 and 86.

The bus bar assembly 82*a* includes two terminal guides 102. Each of the terminal guides 102 is sized and shaped to fit on a respective one of the plug terminals 84 and 86. The illustrated terminal guides 102 are made of non-conductive plastic, but may be made of any desired material.

The terminal assembly 74 includes a terminal retainer 104. The terminal retainer is adapted to retain the bus bar assemblies 82*a* and 82*b* in the terminal housing 78 of the plug assembly 24. The illustrated terminal retainer 104 is made of non-conductive plastic, but may be made of any desired material. The terminal retainer 104 includes four guide openings 106 that are each sized and shaped to accommodate one of the terminal guides 102 being inserted through and retained therein.

Figure 14:
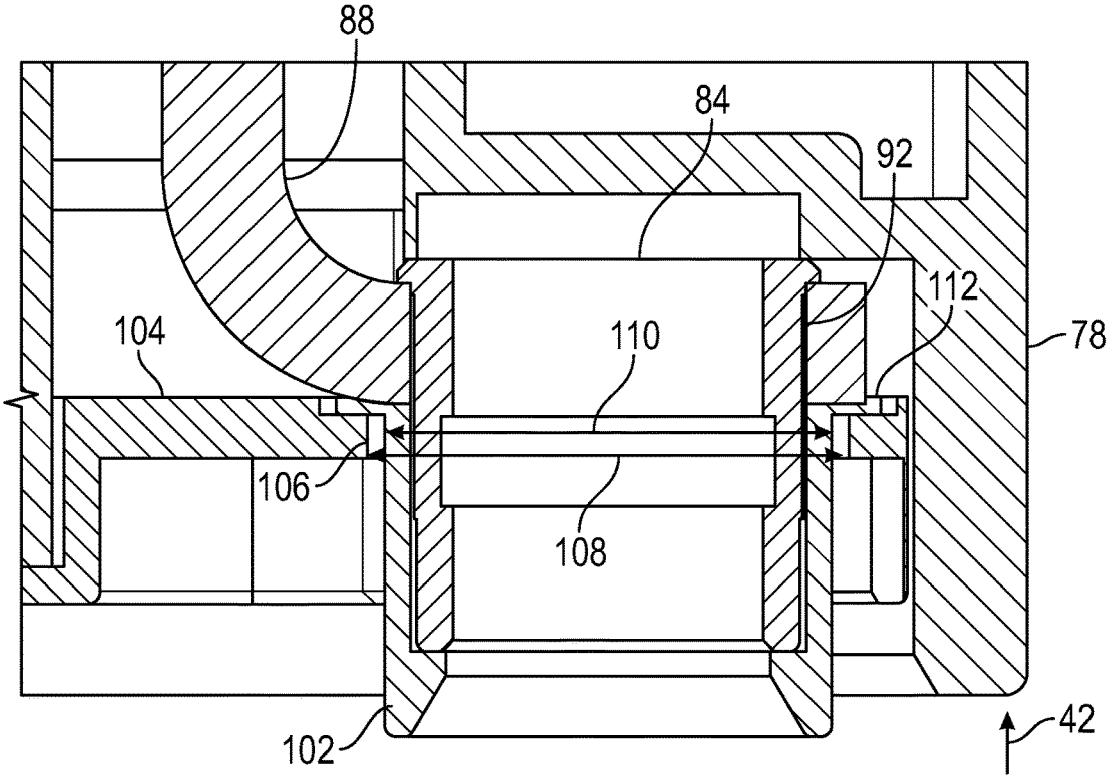
FIG. 14 is a cross-sectional view of a portion of the plug assembly.

Referring now to FIG. 14, there is illustrated a cross-sectional view of a portion of the assembled plug assembly 24. The cross-section is taken through a centerline of the plug terminal 84. As shown, the plug terminal 84 is attached to the terminal lead 88, the terminal guide 102 is attached to the plug terminal 84, and the terminal guide 102 is located in one of the guide openings 106 on the terminal retainer 104. The terminal retainer 104 is snap-fit into the terminal housing 78 and retains the terminal assembly 74 in place relative to the plug body 76.

As shown, the guide opening 106 has an inner diameter 108 that is larger than an outer diameter 110 of the terminal guide 102. This allows the terminal guide 102 to be moved relative to the terminal retainer 104 and relative to the plug body 76. The terminal guide 102 includes a retaining flange 112 that is larger than the guide opening 106, in order to prevent the terminal guide 102 from passing through the guide opening 106. The terminal guide 102 and the guide opening 106 are described by their relative diameters in the illustrated embodiment; however, the terminal guide 102 and the guide opening 106 may have any desired shapes.

Figure 15:
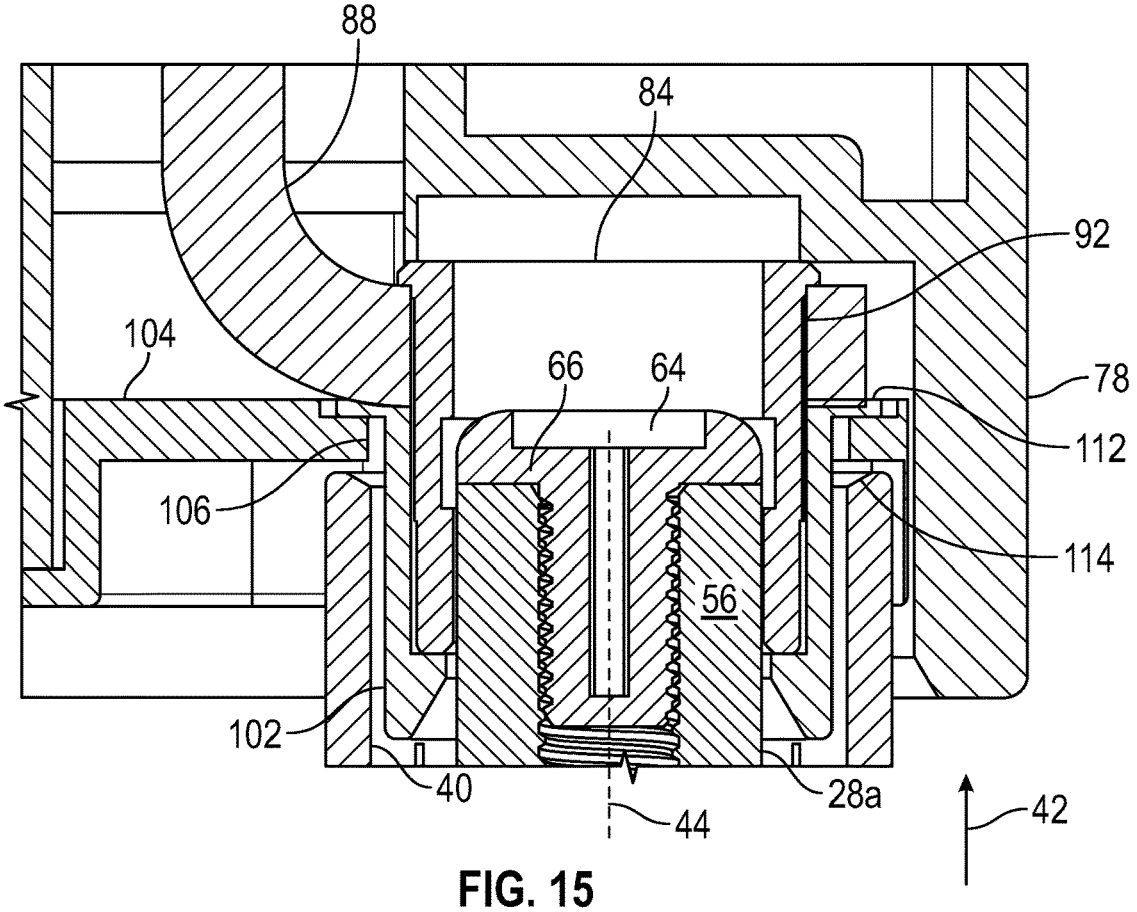
FIG. 15 is a cross-sectional view similar to FIG. 14, with the plug assembly shown in the mated position from FIG. 3.

Referring now to FIG. 15 there is illustrated a view similar to FIG. 14, with the plug assembly 24 shown in the mated position relative to the header assembly 26. As shown, portions of the terminal guide 102 and the plug terminal 84 are located inside the terminal shroud 40, and the plug terminal 84 engages the header terminal 28*a*. As shown, the terminal shroud 40 includes an angled leading edge 114 that funnels into the terminal shroud 40. The leading edge 114 helps to ensure that the terminal guide 102 properly moves into the terminal shroud 40. The terminal guide 102 and the plug terminal 84 are able to be moved relative to the plug body 76 in a plane that is perpendicular to the terminal axis 44. This allows the plug terminal 84 to be moved into proper engagement with the header terminal 28*a* when the plug assembly 24 is mated with the header assembly 26.

Figure 16:
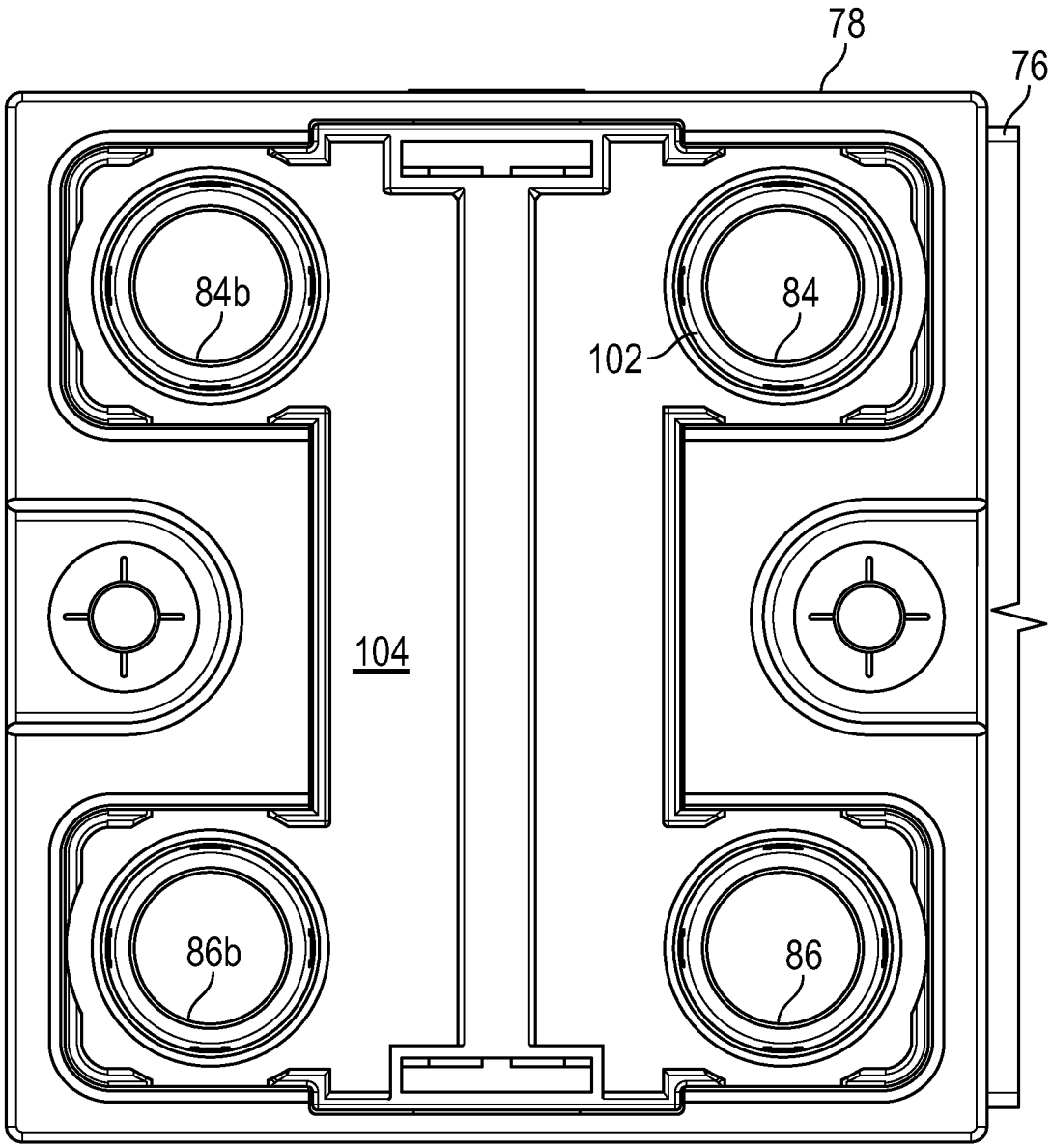
FIG. 16 is an enlarged plan view of the plug assembly, showing the terminal assembly installed in the plug body.

Referring to FIG. 16, there is illustrated a detail view of a portion of the plug assembly 24, showing an end view of the terminal assembly 74. As shown, the plug terminals 84, 86, 84*b*, and 86*b* are arranged generally at the corners of a rectangular-shaped space. This allows each of the plug terminals 84, 86, 84*b*, and 86*b* to engage the respective header terminal 28*a*, 28*b*, 28*c*, and 28*d* when the plug assembly 24 is mated with the header assembly 26. Each of the plug terminals 84, 86, 84*b*, and 86*b* is able to be moved relative to the plug body 76 in the plane that is perpendicular to the terminal axis 44. Additionally, the flexible bus bar 100 and allow the connected plug terminals 84 and 86 to move relative to each other. Thus, each of the plug terminals 84, 86, 84*b*, and 86*b* is able to independently move relative to the plug body 76 in order to ensure that each of the plug terminals 84, 86, 84*b*, and 86*b* properly engages the respective header terminal 28*a*, 28*b*, 28*c*, and 28*d* when the plug assembly 24 is mated with the header assembly 26.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector comprising:

a terminal housing;

a first terminal retained in the terminal housing for movement relative to the terminal housing;

a second terminal retained in the terminal housing for movement relative to the terminal housing;

a flexible bus bar connected to the first terminal and the second terminal, wherein the first terminal is able to be moved independently of the second terminal; and a terminal retainer attached to the terminal housing, wherein the first terminal and the second terminal:

extend through respective guide openings in the terminal retainer;

are smaller than the respective guide openings, and each include a retaining flange that is larger than the guide opening.

2. The electrical connector of claim 1, wherein the flexible bus bar engages two sides of the first terminal and engages two sides of the second terminal.

3. The electrical connector of claim 1, wherein the first terminal is adapted to engage a first mating terminal inserted parallel to a terminal axis.

4. The electrical connector of claim 3, wherein the first terminal is retained in the terminal housing for movement relative to the terminal housing in a plane perpendicular to the terminal axis.

5. The electrical connector of claim 1, wherein the first terminal is adapted to engage a first mating terminal inserted parallel to a terminal axis and the second terminal is adapted to engage a second mating terminal inserted parallel to the terminal axis.

6. The electrical connector of claim 5, wherein the first terminal is retained in the terminal housing for movement relative to the terminal housing in a plane perpendicular to the terminal axis and the second terminal is retained in the terminal housing for movement relative to the terminal housing in the plane perpendicular to the terminal axis.

7. The electrical connector of claim 1, wherein the first terminal is adapted to engage a first mating terminal inserted parallel to a terminal axis and the second terminal is adapted to engage a second mating terminal inserted parallel to the terminal axis.

8. The electrical connector of claim 1, wherein the first terminal is retained in the terminal housing for movement relative to the terminal housing in a plane perpendicular to the terminal axis and the second terminal is retained in the terminal housing for movement relative to the terminal housing in the plane perpendicular to the terminal axis.

9. The electrical connector of claim 1, further including a first terminal guide attached to an outer surface of the first terminal;

a second terminal guide attached to an outer surface of the second terminal; and a terminal retainer attached to the terminal housing;

wherein the first terminal guide and the second terminal guide extend through respective guide openings in the terminal retainer and wherein the first terminal guide and the second terminal guide are smaller than the respective guide opening and each includes a respective retaining flange that is larger than the guide opening.

10. The electrical connector of claim 9, wherein the first terminal is adapted to engage a first mating terminal inserted parallel to a terminal axis and the second terminal is adapted to engage a second mating terminal inserted parallel to the terminal axis.

11. The electrical connector of claim 10, wherein the first terminal guide is retained in the terminal housing for movement relative to the terminal housing in a plane perpendicular to the terminal axis and the second terminal guide is retained in the terminal housing for movement relative to the terminal housing in the plane perpendicular to the terminal axis.

12. An electrical connector comprising:

a terminal housing;

a first terminal retained in the terminal housing for movement relative to the terminal housing;

a second terminal retained in the terminal housing for movement relative to the terminal housing;

a first flexible bus bar connected to the first terminal and the second terminal, wherein the first terminal is able to be moved independently of the second terminal;

a third terminal retained in the terminal housing for movement relative to the terminal housing;

a fourth terminal retained in the terminal housing for movement relative to the terminal housing;

a second flexible bus bar connected to the third terminal and the fourth terminal, wherein the third terminal is able to be moved independently of the fourth terminal;

a first terminal guide attached to an outer surface of the first terminal, a second terminal guide attached to an outer surface of the second terminal, a third terminal guide attached to an outer surface of the third terminal, and a fourth terminal guide attached to an outer surface of the fourth terminal; and a terminal retainer attached to the terminal housing, wherein the first terminal guide, the second terminal guide, the third terminal guide, and the fourth terminal guide:

extend through respective guide openings in the terminal retainer;

are smaller than the respective guide openings; and each include a retaining flange that is larger than the guide opening.

13. The electrical connector of claim 12, wherein the first terminal is adapted to engage a first mating terminal inserted parallel to a terminal axis, the second terminal is adapted to engage a second mating terminal inserted parallel to the terminal axis, the third terminal is adapted to engage a third mating terminal inserted parallel to the terminal axis; and the fourth terminal is adapted to engage a fourth mating terminal inserted parallel to the terminal axis.

14. The electrical connector of claim 13, wherein the first terminal is retained in the terminal housing for movement relative to the terminal housing in a plane perpendicular to the terminal axis, the second terminal is retained in the terminal housing for movement relative to the terminal housing in the plane perpendicular to the terminal axis, the third terminal is retained in the terminal housing for movement relative to the terminal housing in the plane perpendicular to the terminal axis, and the fourth terminal is retained in the terminal housing for movement relative to the terminal housing in the plane perpendicular to the terminal axis.

15. An electrical connector comprising:

a terminal housing;

a first terminal with a first terminal guide attached to an outer surface thereof, the first terminal retained in the terminal housing for movement relative to the terminal housing perpendicular to a terminal axis;

a second terminal with a second terminal guide attached to an outer surface thereof, the second terminal retained in the terminal housing for movement relative to the terminal housing perpendicular to the terminal axis;

a third terminal with a third terminal guide attached to an outer surface thereof, the third terminal retained in the terminal housing for movement relative to the terminal housing perpendicular to the terminal axis;

a fourth terminal with a fourth terminal guide attached to an outer surface thereof, the fourth terminal retained in the terminal housing for movement relative to the terminal housing perpendicular to the terminal axis;

a first flexible bus bar connected to the first terminal and the second terminal, wherein the first terminal is able to be moved independently of the second terminal;

a second flexible bus bar connected to the third terminal and the fourth terminal, wherein the third terminal is able to be moved independently of the fourth terminal; and a terminal retainer attached to the terminal housing;

wherein the first terminal guide, the second terminal guide, the third terminal guide, and the fourth terminal guide extend through respective guide openings in the terminal retainer and wherein the first terminal guide, the second terminal guide, the third terminal guide, and the fourth terminal guide are smaller than the respective guide opening and each includes a respective retaining flange that is larger than the guide opening.

* * * * *